US008228242B2

(12) United States Patent
Gong et al.

(10) Patent No.: US 8,228,242 B2
(45) Date of Patent: Jul. 24, 2012

(54) ULTRA WIDE BAND SECONDARY ANTENNAS AND WIRELESS DEVICES USING THE SAME

(75) Inventors: Shaofang Gong, Norrkoping (SE); Owais Owais, Linkoping (SE); Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 392 days.

(21) Appl. No.: 12/566,897

(22) Filed: Sep. 25, 2009

(65) Prior Publication Data

US 2011/0074638 A1 Mar. 31, 2011

(51) Int. Cl.
*H01Q 1/24* (2006.01)

(52) U.S. Cl. ..... 343/702

(58) Field of Classification Search ..... 343/700 MS, 343/702, 767–769
See application file for complete search history.

(56) References Cited

U.S. PATENT DOCUMENTS

| | | | | |
|---|---|---|---|---|
| 5,768,691 | A | 6/1998 | Matero et al. | |
| 6,937,193 | B2 * | 8/2005 | Hendler et al. | 343/700 MS |
| 7,042,401 | B2 * | 5/2006 | Park et al. | 343/700 MS |
| 7,088,299 | B2 * | 8/2006 | Siegler et al. | 343/745 |
| 7,239,283 | B2 * | 7/2007 | Chua | 343/746 |
| 7,324,049 | B2 * | 1/2008 | Myoung et al. | 343/700 MS |
| 7,557,755 | B2 * | 7/2009 | Han et al. | 343/700 MS |
| 7,639,186 | B2 * | 12/2009 | Chang | 343/700 MS |
| 2001/0050638 | A1 | 12/2001 | Ishitobi | |
| 2002/0107033 | A1 | 8/2002 | Kim | |
| 2003/0210187 | A1 * | 11/2003 | Wong et al. | 343/700 MS |
| 2004/0017315 | A1 * | 1/2004 | Fang et al. | 343/700 MS |
| 2006/0208954 | A1 | 9/2006 | Han | |
| 2008/0238783 | A1 | 10/2008 | Wong et al. | |
| 2009/0121956 | A1 | 5/2009 | Koshiji | |
| 2009/0189815 | A1 | 7/2009 | Hotta | |

FOREIGN PATENT DOCUMENTS

| | | | |
|---|---|---|---|
| EP | 1 388 951 | A2 | 2/2004 |
| EP | 1 517 399 | A1 | 3/2005 |
| GB | 2 380 863 | | 4/2003 |
| KR | 2004-0054107 | | 6/2004 |
| KR | 2004 0054107 | | 6/2004 |
| WO | WO 02/078123 | | 10/2002 |
| WO | WO 03/094290 | A1 | 11/2003 |

OTHER PUBLICATIONS

Invitation to Pay Additional Fees and, where Applicable, Protest Fee, for PCT/IB2020/051353, dated Jul. 26, 2010.

Notification of Transmittal of the International Search Report and the Written Opinion of the International Searching Authority, or the Declaration; International Search Report; Written Opinion of the International Searching Authority corresponding to International Application No. PCT/IB2010/051353; Date of mailing: Oct. 28, 2010, 14 pages.

* cited by examiner

*Primary Examiner* — Huedung Mancuso
(74) *Attorney, Agent, or Firm* — Myers Bigel Sibley & Sajovec

(57) ABSTRACT

A secondary antenna in a wireless communication terminal is provided. The secondary antenna includes an electrically conductive planar element that includes a first edge that is substantially linear and that includes a first length. The electrically conductive planar element may include a second edge that is substantially linear, that is opposite the first edge and that includes a second length that is less than the first length. At least one curved edge may be arranged between the first edge and the second edge. At least one elongated slot that is substantially perpendicular to the second edge may originates from a transition portion between the at least one curved edge and the second edge.

18 Claims, 5 Drawing Sheets

ULTRA WIDE BAND SECONDARY ANTENNAS AND WIRELESS DEVICES USING THE SAME

BACKGROUND

Portable and hand-held computing and communications devices with wireless communication capabilities may have signal transmission or reception issues depending, for example, on the relative sizes of the devices and/or the signal wavelengths used. Antennas of various types have been used with such devices. Such antennas have radiated or received electromagnetic signals with varying degrees of effectiveness depending upon the physical types, orientations, sizes and/or structural configurations of the antennas, particularly in view of the wavelengths of the signals to be transmitted or received.

In addition to challenges related to the relative sizes of hand-held computing and communications devices, such devices may incorporate an increasing number of frequency bands corresponding to a variety of communication protocols and/or devices. For example, multi-band and/or multi-system communications may present significant transmission and/or reception issues in the context of hand-held computing and/or communications devices.

SUMMARY

Embodiments according to the present invention can provide a secondary antenna in a wireless communication terminal. The secondary antenna includes an electrically conductive planar element that includes a first edge that is substantially linear and that includes a first length. A second edge that is substantially linear is arranged opposite the first edge and includes a second length that is less than the first length. At least one curved edge is arranged between the first edge and the second edge and at least one elongated slot is substantially perpendicular to the second edge and originates from a transition portion between the at least one curved edge and the second edge.

In some embodiments, the at least one curved edge includes a first curved edge and a second curved edge such that each of the first and second curved edges include a substantially similar radius of curvature, and/or combination thereof. Some embodiments provide that the first and second curved edges are arranged between respective ends of the first edge and the second edge and extend continuously along at least a major portion of a surface therebetween. In some embodiments, the at least one elongated slot includes a first elongated slot that is substantially perpendicular to the second edge and is arranged at a first transition portion that is between the first curved edge and the second edge. A second elongated slot may be substantially perpendicular to the second edge and may be arranged at a second transition portion that is between the second curved edge and the second edge.

Some embodiments include an elongated portion extending from the second edge. In some embodiments, a gap is defined between the second edge and an edge of a conductive ground plane and includes a dielectric material. Some embodiments provide that the gap is about 1 mm. In some embodiments, the gap may include air and/or any other dielectric material. Some embodiments include an inductive and/or resistive load coupled to the elongated portion to provide tuning functionality corresponding to a low frequency band limit.

In some embodiments, the electrically conductive planar element includes a dual chop circular monopole radiator with multiple slots.

Some embodiments provide that the electrically conductive planar element is configured to be bent at an angle formed along a line that is substantially parallel to the second edge and that is positioned substantially adjacent an internal end of the at least one elongated slot.

Some embodiments include a third edge, wherein each of the third edge and the at least one curved edge are arranged between respective ends of the first edge and the second edge and extend continuously along at least a major portion of a surface therebetween. Some embodiments include an elongated portion extending from the second edge. Some embodiments provide that a gap that includes a dielectric material is defined between a top edge of the conductive ground plane and the second edge of the electrically conductive planar element. In some embodiments, the gap is about 1 mm and the dielectric material is air or any other dielectric material. Some embodiments provide that the conductive ground plane includes a first elongated portion that is substantially parallel to the third edge and a second elongated portion attached to the first elongated portion and that extends in a direction that is substantially parallel to and substantially adjacent the first edge. An inductive and/or resistive load may be coupled to the elongated portion to provide tuning functionality corresponding to a low frequency band limit.

In some embodiments, the electrically conductive planar element includes a vertically cut portion of a dual chop circular monopole radiator with a slot.

Some embodiments of the present invention include a wireless device that includes a secondary antenna as described herein. A wireless device according to some embodiments may include a main antenna that is operable corresponding to a first frequency band. The secondary antenna may be operable corresponding to a second frequency band that is different from the first frequency band. A switching device may be operable to selectively connect the main antenna or the secondary antenna responsive to whether the wireless device is operating in the first frequency band or the second frequency band.

In some embodiments, the switching device includes a multiplexor that is configured to selectively communicatively couple ones of multiple transceivers in corresponding ones of multiple frequency bands with one of the main antenna or the secondary antenna. Some embodiments provide that the first frequency band includes a range of about 700-960 MHz and the second frequency band includes a range of about 1.35-11.5 GHz.

Some embodiments of the present invention include a wireless device that includes a tunable main antenna that is tuned to operate in a cellular communications frequency band, a dual chop circular monopole radiator that includes multiple slots, and a switching device that is operable to selectively couple the tunable main antenna or the dual chop circular monopole radiator to at least one of multiple transceivers that correspond to multiple frequency bands, respectively.

DETAILED DESCRIPTION

Figure 1:
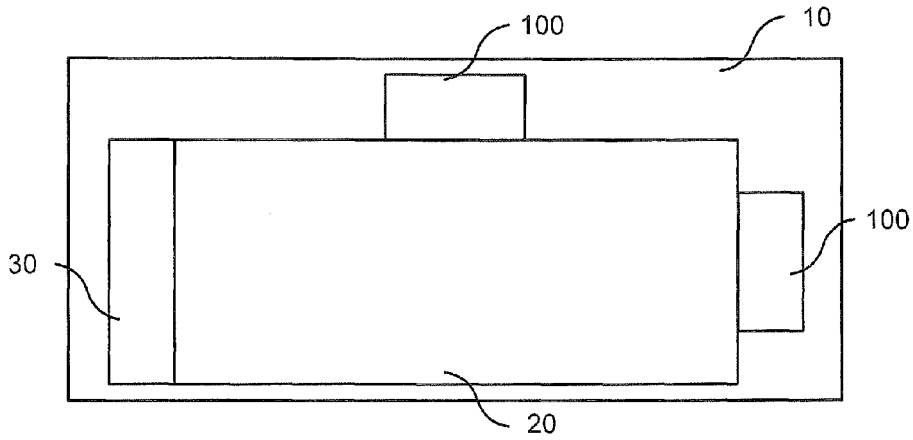
FIG. 1 is a block diagram illustrating a wireless device that includes a secondary antenna according to some embodiments of the present invention.

The invention is described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specific disclosure and will not be interpreted in an idealized or overly formal sense unless expressly so defined herein.

It should be emphasized that the term "comprises/comprising" when used in this specification is taken to specify the presence of stated features, integers, steps or components but does not preclude the presence or addition of one or more other features, integers, steps, components or groups thereof.

It will be understood that although the terms first and second may be used herein to describe various components these components should not be limited by these terms. These terms are only used to distinguish one component from another. Thus, for example, a first component discussed below could be termed a second component without departing from the teachings of the present invention.

It will be understood mobile terminals and/or wireless devices according to the invention may operate in any type of wireless communications network. In some embodiments according to the invention, for example, the network may provide services broadly labeled as PCS (Personal Communications Services) including advanced digital cellular systems conforming to standards such as IS-136 and IS-95, lower-power systems such as DECT (Digital Enhanced Cordless Telephone), data communications services such as CDPD (Cellular Digital Packet Data), and other systems such as CDMA-2000, that are proposed using a format commonly referred to as Wideband Code Division Multiple Access (WCDMA).

For purposes of illustration and explanation only, various embodiments of the present invention are described herein in the context of mobile terminals that are configured to carry out cellular communications (e.g., cellular voice and/or data communications) and/or short range communications (e.g., wireless local area network and/or Bluetooth). It will be understood, however, that the present invention is not limited to such embodiments and may be embodied generally in any wireless communication terminal that is configured to communicate over an ultra wide frequency band using, for example, multiple different protocols, functions, and/or applications.

Brief reference is made to FIG. 1, which is a block diagram illustrating a wireless device that includes a secondary antenna according to some embodiments of the present invention. A wireless device 10 may include a circuit board 20 (CB) (e.g., a printed circuit board), on which multiple electronic components may be mounted and/or connected to. For example, a CB 20 may include multiple transceiver modules and/or circuits that are operable to transmit/receive communications in a variety of different frequency bands using a variety of different communication protocols. For example, the wireless device 10 may be configured to communicate using cellular bands, multiple channel protocols (diversity), global positioning system (GPS), multiple-input multiple-output (MIMO), wireless local area network standards such as IEEE 802.11 (WiFi), personal area network protocols (Bluetooth), broadband wireless (WiMax) and/or ultra-wide band (UWB) applications, among others.

A primary and/or main antenna 30 may be electrically coupled to the CB 20 and may be operable to transmit and/or receive electromagnetic waves in, for example, a frequency range corresponding to one or more cellular bands and/or protocols. A secondary antenna 100 may be electrically coupled to the CB 20 and may be operable to transmit and/or receive electromagnetic waves in, for example, frequency ranges corresponding to one or more non-cellular bands and/or protocols. For example, the secondary antenna 100 may be operable to transmit and/or receive multiple channel protocols (diversity), global positioning system (GPS), multiple-input multiple-output (MIMO), wireless local area network standards such as IEEE 802.11 (WiFi), personal area network protocols (Bluetooth), broadband wireless (WiMax) and/or ultra-wide band (UWB) applications, among others. In some embodiments, multiple secondary antennas 100 may be used to selectively and/or simultaneously attenuate according to one or more frequency bands, protocols and/or applications.

Figure 2A:
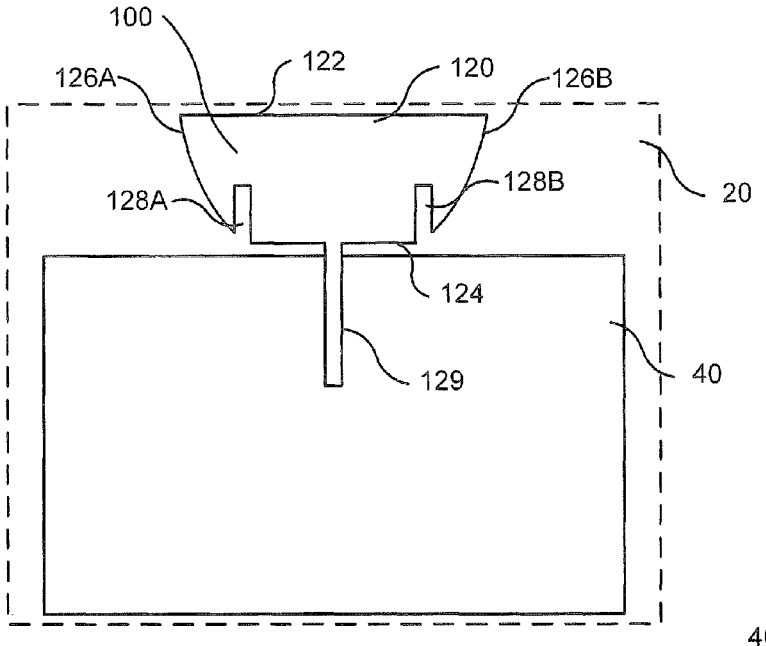
FIGS. 2A and 2B are schematic diagrams illustrating front and side views of an antenna arrangement including a secondary antenna according to some embodiments of the present invention.
Figure 2B:
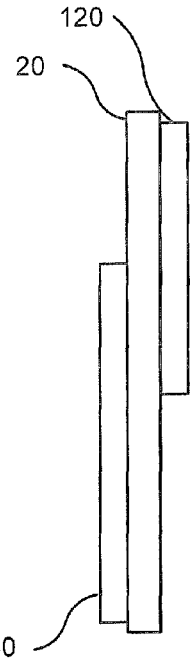

Reference is now made to FIGS. 2A and 2B, which are schematic diagrams illustrating front and side views of an antenna arrangement including a secondary antenna according to some embodiments of the present invention. Referring to FIG. 2A, a CB 20 may be provided on which an electrically conductive ground plane 40 may be engaged. Some embodiments provide that the ground plane 40 may be mounted on and/or attached to the CB 20.

A secondary antenna 100 may be attached to and/or mounted on the CB 20 to supplement the attenuation characteristics of a primary and/or main antenna (not shown here). The secondary antenna 100 may include an electrically conductive planer element 120. The planer element 120 may be formed using, for example, a metallic sheet product, among others. The planer element 120 may include a first edge 122 and a second edge 124 that is substantially opposite the first edge 122. The first edge 122 may be substantially linear and may include a first length is greater than a second length of the second edge 124, which may be substantially linear.

At least one curved edge 126 may be arranged between the first edge 122 and a second edge 124. The curved edge 126 may extend continuously along at least a major portion of the edge. Some embodiments provide that first and second curved edges 126A, 126B may be symmetrically arranged between respective ends of the first and second edges 122, 124. The curved edges 126A, 126B may include substantially similar radii of curvatures and/or combinations thereof.

At least one elongated slot 128 that is substantially perpendicular to the second edge 124 may be provided. The at least one elongated slot 128 may originate at an edge of the planar element 120 that is proximate a transition portion that is between the at least one curved edge 126 and the second edge 124. Some embodiments provide that first and second elongated slots 128A, 128B may be provided and be proximate first and second curved edges 126A, 126B, respectively. In some embodiments, the first and second elongated slots 128A, 128B may be located at a defined distance from a centerline of the planar element 120 along the second edge 124. The first and second elongated slots 128A,128B may be substantially similar to one another regarding size, orientation and/or position, among others.

Some embodiments of the present invention may include an elongated portion 129 that extends from the second edge 124. As illustrated in FIG. 2B, the ground plane 40 and the secondary antenna 100 may be positioned on opposite sides of the CB 20. In some unillustrated embodiments, the ground plane 40 and the secondary antenna 100 may be substantially coplanar. In this regard, the elongated portion 129 may include a microstrip feedline. Some embodiments provide that the elongated portion 129 may include an inductive and/or resistive load to tune the frequency response of the secondary antenna 100. For example, loading may provide tuning functionality corresponding to a low frequency band limit.

Some embodiments of the present invention provide that a gap may be defined between the second edge 124 and an edge of the ground plane 40. The gap may include a dielectric material, including, for example, air. In some embodiments, the gap may be about 1 mm and the dielectric material may include air.

As illustrated, the secondary antenna 100 may be a substantially semi-circular antenna chopped at the lower side, which may be referred to as a dual-chop circular monopole antenna. The ground plane 40 may be substantially rectangular. In some embodiments, a width of the ground plane 40 may be about half of the wavelength and a height may be about a quarter of the wavelength of the minimum resonant frequency. Some embodiments provide that that the minimum resonant frequency is around 3.2 GHz. In this regard, the diameter of the secondary antenna 100 (the length of the first edge 122) may be about 30 mm. The height of the antenna may be about 16 mm owing to the dual chop.

The proximity of the second egde 124 and the ground plane 40 may produce strong capacitive coupling therebetween. In this regard, a strong current distribution may be concentrated at the second edge 124, which may significantly influence the antenna characteristics.

The elongated slots 128A, 128B may be symmetrically located relative to the center line of the secondary antenna 120. Some embodiments provide that the elongated slots 128A, 128B may have a uniform width of about 1 mm and a height of about 3 mm, and may be placed at a distance of about 6.4 mm from the elongated portion 129. The distance between the elongated slots 128A, 128B and the centerline may impact the bandwidth characteristics. For example, when the distance of the elongated slots 128A, 128B to the center line increases or decreases, the bandwidth characteristic may be degraded. Similarly, changes in the height and/or width of the elongated slots 128A, 128B may affects the antenna characteristics.

Figure 3:
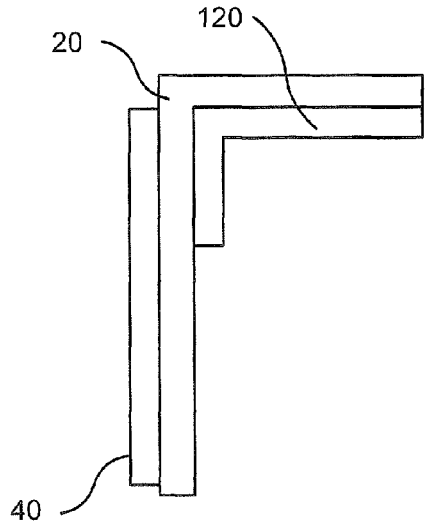
FIG. 3 is a schematic diagram illustrating a side view of an antenna arrangement including a secondary antenna according to some embodiments of the present invention.

Although illustrated as substantially planar in FIGS. 2A and 2B, the secondary antenna 100 may be formed in a non-planar arrangement. For example, brief reference is made to FIG. 3, which is a schematic diagram illustrating a side view of an antenna arrangement including a bent secondary antenna 100 according to some embodiments of the present invention. Some embodiments provide that the planar element 120 may be bent at an angle that is formed along a line that may be substantially parallel to the second edge (124, FIG. 2B). In some embodiments, the line may be positioned proximate an internal end of the at least one elongated slot 128. For example, the line may extend between the internal ends of the first and second elongated slots (128A, 128B, FIG. 2B).

In this manner, the secondary antenna 100 may be designed such that the planar element 120 can be bent 90°, vertical and/or an arcuate shape, and thus may be positioned at an edge of a CB 20. By bending the CB 20 and the planar element 120, the requisite space may be reduced. In this manner, the secondary antenna 100 may be placed in a mobile phone, a laptop PC and/or any other type of portable devices where there is a ground plane that includes a width that is substantially twice the diameter of the antenna.

In some embodiments, the secondary antenna may cover a frequency band from about 2.4 to about 12.5 GHz with good performance, whether bent or unbent.

Figure 4A:
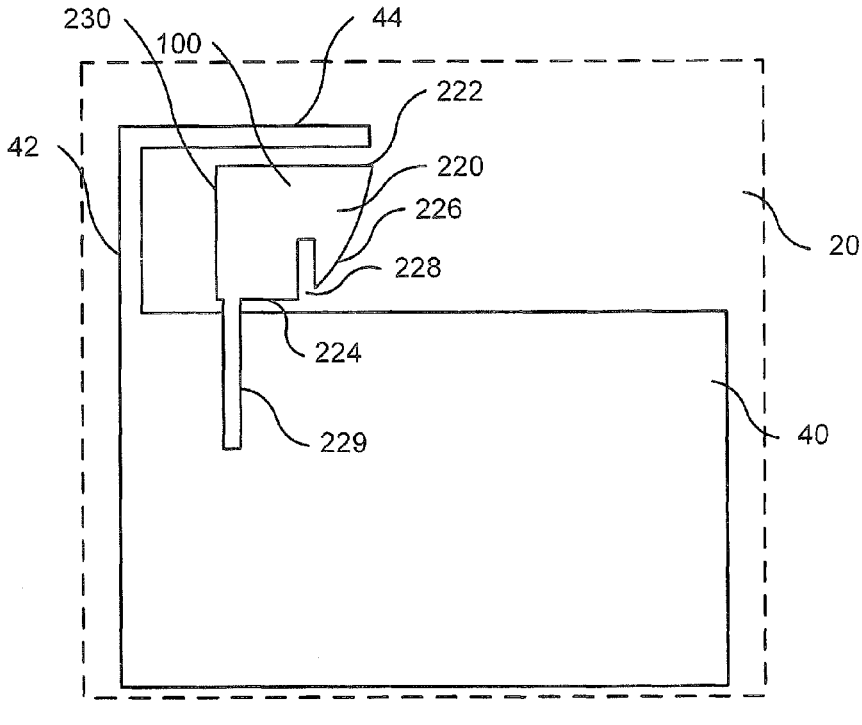
FIGS. 4A and 4B are schematic diagrams illustrating front and side views of an antenna arrangement including a secondary antenna according to some embodiments of the present invention.
Figure 4B:
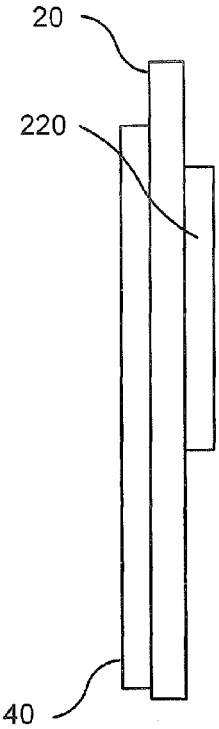

Reference is now made to FIGS. 4A and 4B, which are schematic diagrams illustrating front and side views of an antenna arrangement including a secondary antenna according to some embodiments of the present invention. Some embodiments of the secondary antenna 100 may include a vertically cut portion of a dual chop circular monopole radiator with a slot. For example, an electrically conductive planar element 220 may include a first edge 222 and a second edge 224 that is substantially opposite the first edge and that includes length that is less than the length of the first edge 222. A curved edge 226 may be arranged between corresponding ends of the first and second edges 222, 224. A third edge 230 may be arranged between the other corresponding ends of the first and second edges 222, 224. In some embodiments, the third edge 230 may be oriented substantially perpendicular to the first and second edges 222, 224. An elongated slot 228 that is substantially perpendicular to the second edge 224 may be provided. The elongated slot 228 may originate at an edge of the planar element 220 that is proximate a transition portion that is between the curved edge 226 and the second edge 224. Some embodiments provide that elongated slot 228 may be provided and be proximate the curved edge 226.

Some embodiments of the present invention may include an elongated portion 229 that extends from the second edge 224. As illustrated in FIG. 4B, the ground plane 40 and the secondary antenna 100 may be positioned on opposite sides of the CB 20. In some unillustrated embodiments, the ground plane 40 and the secondary antenna 100 may be substantially coplanar. In this regard, the elongated portion 229 may include a microstrip feedline. Some embodiments provide that the elongated portion 229 may include an inductive and/or resistive load to tune the frequency response of the secondary antenna 100. For example, loading may provide tuning functionality corresponding to a low frequency band limit.

Some embodiments provide that the ground plane 40 includes a first elongated portion 42 that is substantially parallel to the third edge 230 and a second elongated portion 44 that extends from a distal end of the first elongated portion 42 in a direction that is substantially parallel to and substantially adjacent the first edge 222. In some embodiments, a combination including the vertically cut portion of a dual chop circular monopole radiator with a slot and the first and second elongated portions of the ground plane 42, 44 may extend the bandwidth towards the lower frequency end and reduce size. Some embodiments provide that the antenna 100 may perform in a frequency band from about 1.35 to about 11.5 GHz.

Regarding exemplary dimensions, some embodiments provide that the first edge 222 may be about 17 mm, a distance from the first edge 222 to the second edge 224 may be about 16 mm and a length of a second elongated portion of the ground plane 44 may be about 26 mm. In some embodiments, a distal end of the second elongated portion of the ground plane 44 may be about adjacent an intersection between the first edge 222 and the curved edge 226. Some embodiments provide that the ground plane 40 may substantially rectangular and be about 56 mm in the direction of the third edge 230 and about 50 mm in the direction of the second edge 224.

Figure 5:
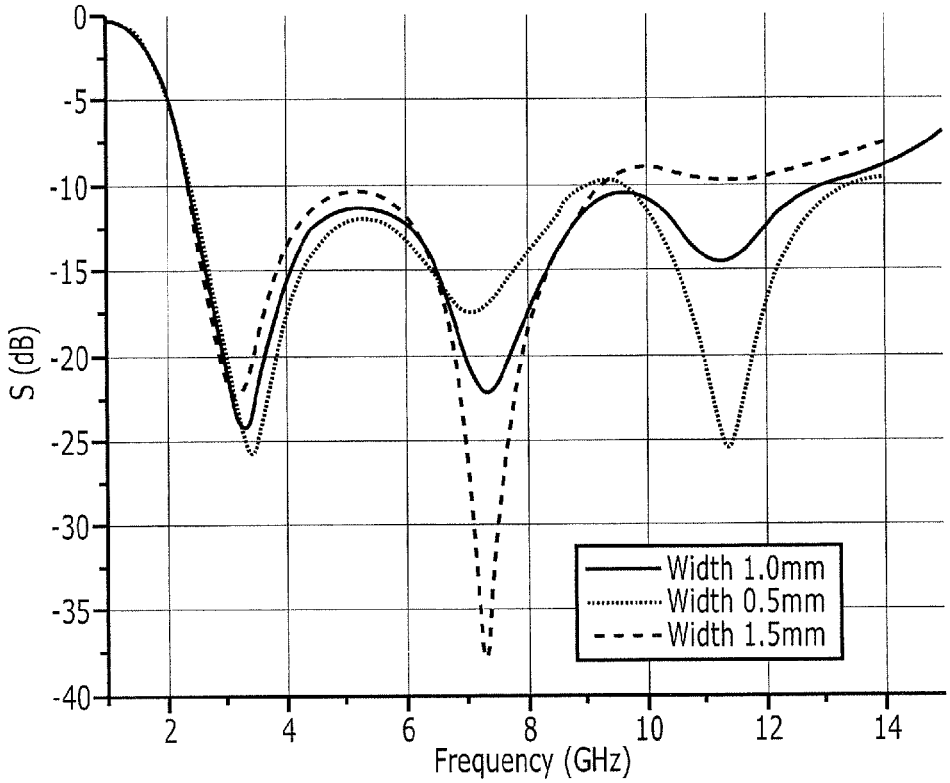
FIG. 5 is a graph plotting simulated results of the return loss of dual-chop monopole secondary antennas having different slot widths according to some embodiments of the present invention.

Reference is now made to FIG. 5, which is a graph plotting simulated results of the return loss of dual-chop monopole secondary antennas having different slot widths according to some embodiments of the present invention. The graph includes simulated S-parameter data expressed in dB plotted as a function of frequency. S-parameters are properties used to describe electrical behavior in linear electrical networks when undergoing various steady state stimuli by small signals. The S-parameters may be used in networks operating a radio frequency (RF) and microwave frequencies where signal and energy considerations may be more easily quantified than currents and voltages. FIG. 5 shows the reverse transmission coefficient for the dual-chop monopole antenna with slots having widths of 0.5, 1.0 and 1.5 mm. The dual-chop monopole with 1.0 mm slot widths ranges from 2.4-12.7 GHz at a return loss of −10 dB. As illustrated, when the slot width is varied from 1 to 1.5 and 0.5 mm, the bandwidth may reduce at upper ends to about 9 GHz. Additionally, regarding a slot width of 1.5 mm, the impedance matching may deteriorate significantly at 9 GHz and may result in a bandwidth of, for example, about 2.4 to about 9 GHz.

Figure 6:
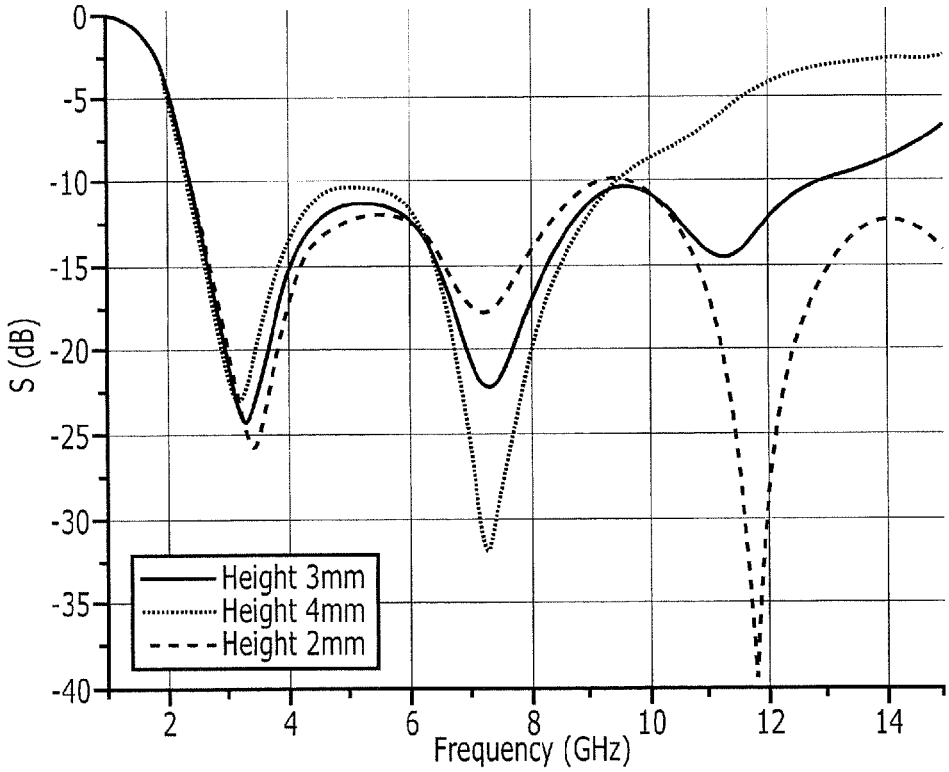
FIG. 6 is a graph plotting simulated results of the return loss of dual-chop monopole secondary antennas having different slot heights according to some embodiments of the present invention.

Reference is now made to FIG. 6, which is a graph plotting simulated results of the return loss of dual-chop monopole secondary antennas having different slot heights according to some embodiments of the present invention. The dual-chop monopole with 3 mm height slots ranges from 2.4-12.7 GHz at a return loss of −10 dB. The height of the slot is swept above and below the nominal value of 3 mm to heights of 2 mm and 4 mm. When the slot height is reduced to 2 mm the impedance bandwidth may be reduced at the upper end to 9.4 GHz. Additionally, when the slot height is increased to 4 mm, the impedance bandwidth may also reduce to 9.4 GHz at the upper frequency end.

Figure 7:
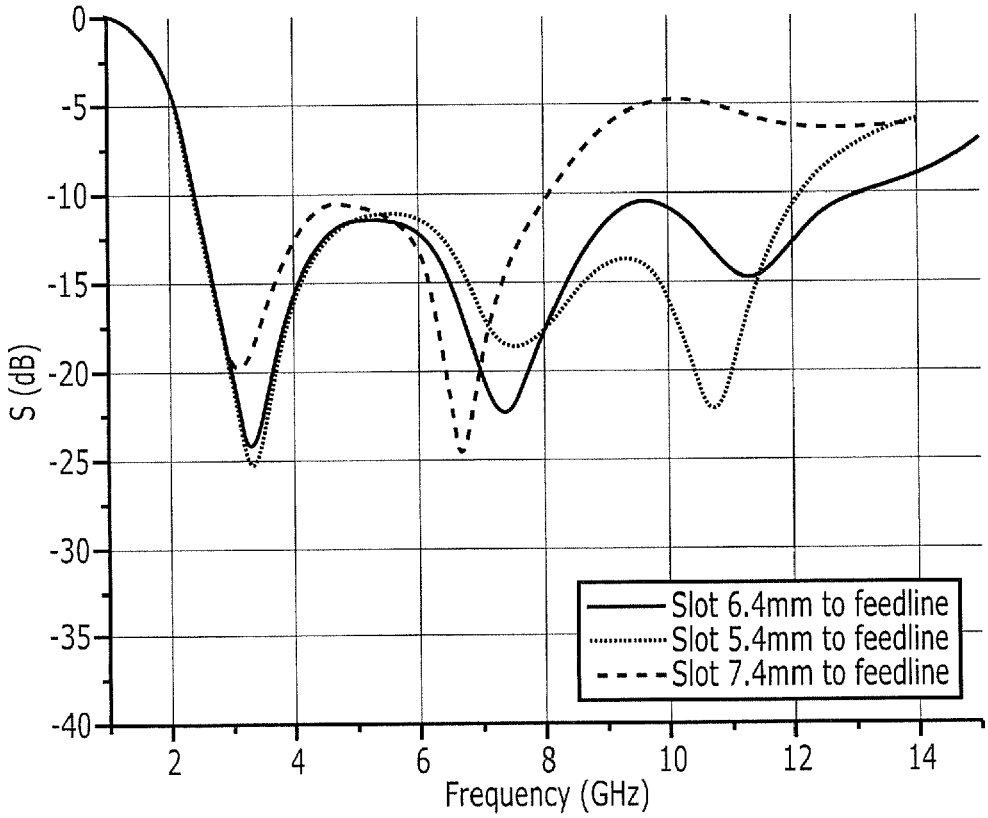
FIG. 7 is a graph plotting simulated results of the return loss of dual-chop monopole secondary antennas having different slot locations relative to a feedline according to some embodiments of the present invention.

Reference is now made to FIG. 7, which is a graph plotting simulated results of the return loss of dual-chop monopole secondary antennas having different slot locations relative to a feedline according to some embodiments of the present invention. As illustrated, the dual-chop monopole with slots at 6.4 mm from the feedline ranges 2.4-12.7 GHz at a return loss of −10 dB. The frequency bandwidth may be reduced when the slot position relative to the feedline is increased or decreased. For example, when the slots are at a position that is 5.4 mm from the feedline, the bandwidth may reduce at both ends to about 2.4 to about 8 GHz. Although not as severe, when the slots are positioned at 7.4 mm from the feedline the bandwidth may be reduced at the upper end to be about 12 GHz.

Figure 8:
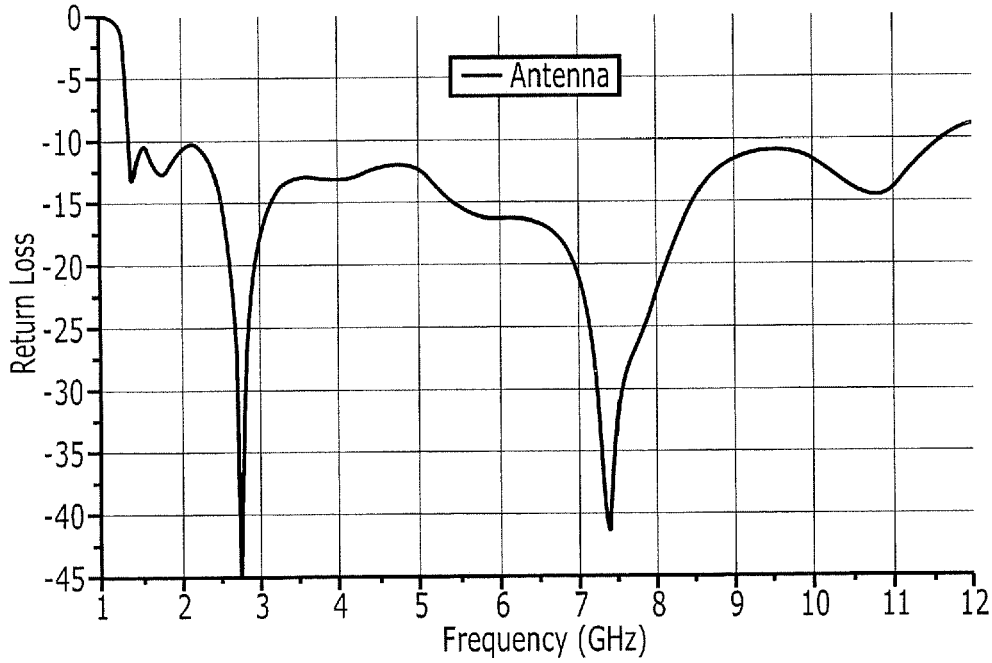
FIG. 8 is a graph plotting simulated results of the return loss of a vertically cut portion of a dual chop circular monopole radiator with a slot and ground plane elongated portions according to some embodiments of the present invention.

Reference is now made to FIG. 8, which is a graph plotting simulated results of the return loss of a vertically cut portion of a dual chop circular monopole radiator with a slot and ground plane elongated portions according to some embodiments of the present invention. The inclusion of the ground plane elongated portions may have the effect of extending the antenna bandwidth in the lower frequency end while the slot may have the effect of increasing the higher end frequency. In this regard, for example, the antenna may then cover the GPS band at 1.5 GHz. As illustrated, the bandwidth may range from about 1.35 to about 11.5 GHz at a return loss of −10 dB.

Figure 9:
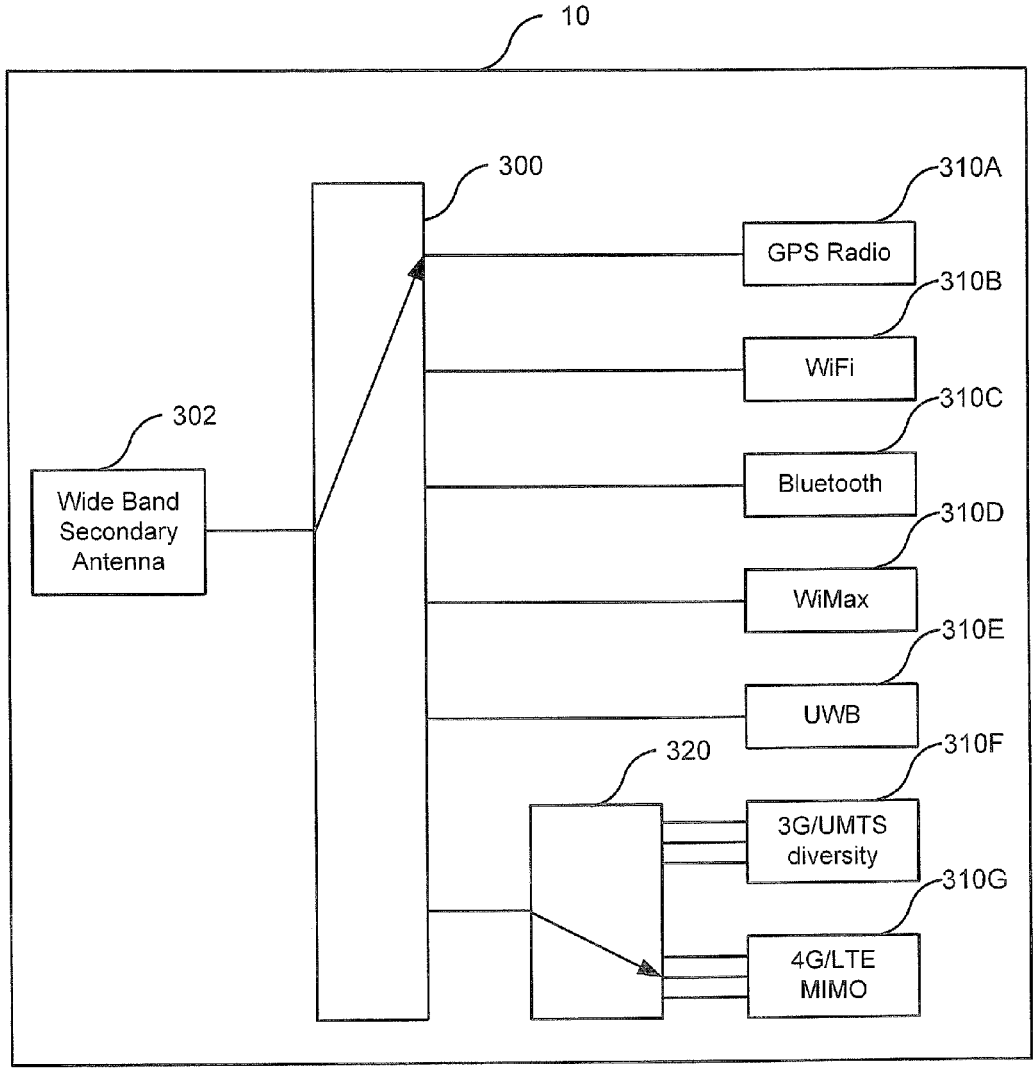
FIG. 9 is a block diagram illustrating an exemplary architecture for providing a switching function of a secondary antenna in conjunction with multiple frequency protocol transceivers, functions and/or applications in a wireless device according to some embodiments of the present invention.

FIG. 9 is a block diagram illustrating a wireless device with an exemplary architecture for providing a switching function of a secondary antenna in conjunction with multiple frequency protocol transceivers, functions and/or applications in the wireless device according to some embodiments of the present invention. The wireless device 10 may include a wide band secondary antenna 302 that is configured to transmit and/or receive electromagnetic waves having a wide band of frequencies. The wireless device 10 may include multiple applications, transceivers and/or functions 310A-G that are operable to transmit and/or receive in multiple bands and/or protocols. Such applications, transceivers and/or functions 310A-G may include GPS radio, WiFi, Bluetooth, WiMax, UWB, 3G/UMTS diversity, and/or 4G/LTE MIMO, among others.

The wireless device 10 may include a switching device 300 that is configured to selectively connect a main antenna (not shown), the secondary antenna 302 and/or a combination thereof to one or more of the applications, transceivers, and/or functions 310A-G. In some embodiments, the main antenna may operate in a frequency range of about 700-960 MHz and the secondary antenna 302 may operate in a frequency range of abut 1.35-11.5 GHz. In some embodiments, the switching device 300 may include one or more multiplexers. Some embodiments may include a diplexor 320 to provide simultaneous operation of multiple ones of the applications, transceivers and/or functions.

In the drawings and specification, there have been disclosed embodiments of the invention and, although specific terms are employed, they are used in a generic and descriptive sense only and not for purposes of limitation, the scope of the invention being set forth in the following claims.

What is claimed:

1. A secondary antenna in a wireless communication terminal, the secondary antenna comprising:

an electrically conductive planar element comprising:

a first edge that is substantially linear and that includes a first length;

a second edge that is substantially linear, that is opposite the first edge and that includes a second length that is less than the first length;

at least one curved edge that is arranged between the first edge and the second edge;

at least one elongated slot that is substantially perpendicular to the second edge and that originates from a transition portion between the at least one curved edge and the second edge; and a third edge, wherein each of the third edge and the at least one curved edge are arranged between respective ends of the first edge and the second edge and extend continuously along at least a major portion of a surface therebetween.

2. The secondary antenna according to claim 1, wherein the at least one curved edge comprises a first curved edge and a second curved edge, each of the first and second curved edges comprising a substantially similar radius of curvature.

3. The secondary antenna according to claim 2, wherein the first and second curved edges are arranged between respective ends of the first edge and the second edge and extend continuously along a major portion of a surface therebetween.

4. The secondary antenna according to claim 2, wherein the at least one elongated slot comprises:

a first elongated slot that is substantially perpendicular to the second edge and is arranged at a first transition portion that is between the first curved edge and the second edge; and a second elongated slot that is substantially perpendicular to the second edge and is arranged at a second transition portion that is between the second curved edge and the second edge.

5. The secondary antenna according to claim 2, further comprising an elongated portion extending from the second edge.

6. The secondary antenna according to claim 5, wherein a gap is defined between the second edge and an edge of the conductive ground plane and includes a dielectric material, and wherein the gap comprises about 1 mm and the dielectric material comprises air.

7. The secondary antenna according to claim 5, further comprising an inductive and/or resistive load coupled to the elongated portion to provide tuning functionality corresponding to a low frequency band limit.

8. The secondary antenna according to claim 1, wherein the electrically conductive planar element comprises a dual chop circular monopole radiator with a plurality of slots.

9. The secondary antenna according to claim 1, wherein the electrically conductive planar element is configured to be bent at an angle formed along a line that is substantially parallel to the second edge and that is positioned substantially adjacent an internal end of the at least one elongated slot.

10. The secondary antenna according to claim 1, further comprising an elongated portion extending from the second edge, and wherein a gap that includes a dielectric material is defined between a top edge of a conductive ground plane and the second edge of the electrically conductive planar element.

11. The secondary antenna according to claim 10, wherein the gap is about 1 mm and wherein the conductive ground plane comprises a first elongated portion that is substantially parallel to the third edge and a second elongated portion attached to the first elongated portion and extends in a direction that is substantially parallel to and substantially adjacent the first edge.

12. The secondary antenna according to claim 10, further comprising an inductive and/or resistive load coupled to the elongated portion to provide tuning functionality corresponding to a low frequency band limit.

13. The secondary antenna according to claim 1, wherein the electrically conductive planar element comprises a vertically cut portion of a dual chop circular monopole radiator with a slot.

14. A wireless device, the device comprising the secondary antenna according to claim 1.

15. The wireless device according to claim 14, further comprising a main antenna that is operable corresponding to a first frequency band, wherein the secondary antenna is operable corresponding to a second frequency band that is different from the first frequency band.

16. The wireless device according to claim 15, further comprising a switching device that is operable to selectively connect the main antenna or the secondary antenna responsive to whether the wireless device is operating in the first frequency band or the second frequency band.

17. The wireless device according to claim 16, wherein the switching device comprises a multiplexor that is configured to selectively communicatively couple ones of a plurality of transceivers in corresponding ones of a plurality of frequency bands with one of the main antenna or the secondary antenna.

18. The wireless device according to claim 15, wherein the first frequency band includes a range of about 700-960 MHz and the second frequency band includes a range of about 1.35-11.5 GHz.

* * * * *